US010396475B2

(12) United States Patent
Tchaaouaou et al.

(10) Patent No.: US 10,396,475 B2
(45) Date of Patent: Aug. 27, 2019

(54) VICE-TYPE TERMINAL BLOCK FOR INTERCONNECTING TWO THIMBLES AND ASSOCIATED CONNECTION

(71) Applicant: SAFRAN ELECTRICAL & POWER, Blagnac (FR)

(72) Inventors: Ismail Tchaaouaou, Toulouse (FR); Jean-Marc Blineau, Aussonne (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 0 days.

(21) Appl. No.: 16/061,404

(22) PCT Filed: Dec. 9, 2016

(86) PCT No.: PCT/FR2016/053314
§ 371 (c)(1),
(2) Date: Jun. 12, 2018

(87) PCT Pub. No.: WO2017/103396
PCT Pub. Date: Jun. 22, 2017

(65) Prior Publication Data

US 2018/0309212 A1 Oct. 25, 2018

(30) Foreign Application Priority Data

Dec. 17, 2015 (FR) ..... 15 62595

(51) Int. Cl.
*H01R 9/26* (2006.01)
*H01R 11/11* (2006.01)
(Continued)

(52) U.S. Cl.
CPC ..... *H01R 9/2616* (2013.01); *H01R 11/11* (2013.01); *H01R 13/22* (2013.01); *H01R 13/62933* (2013.01)

(58) Field of Classification Search
CPC ..... H01R 9/2616; H01R 13/62933; H01R 13/22; H01R 11/11; H01R 4/50;
(Continued)

(56) References Cited

U.S. PATENT DOCUMENTS 3,065,441 A * 11/1962 Leonard ..... H01R 13/28 439/153
3,207,839 A * 9/1965 Joly ..... H01R 13/64 174/72 C
(Continued)

FOREIGN PATENT DOCUMENTS

DE 199 10 021 A1 9/2000
FR 2 048 122 A6 3/1971
(Continued)

OTHER PUBLICATIONS

International Search Report for International Application No. PCT/FR2016/053314 dated Feb. 20, 2017.
(Continued)

*Primary Examiner* — Edwin A. Leon
(74) *Attorney, Agent, or Firm* — Pearne & Gordon LLP

(57) ABSTRACT

A vice-type terminal block for electrically connecting a pair of lugs by clamping them together. Each lug includes a barrel extending along an axis and a radially extending flange connected to the barrel. The flange has, on the opposite side to where the barrel is located, an electrical contact surface normal to the axis. The vice-type terminal block includes two opposing plates and a clamping system. Each plate includes a slot for receiving one of the lugs such that the flange of the lug is on one side of the plate, whereas the barrel is on the other side. The pair of lugs are supported such that their electrical contact surfaces face one another and are aligned.

9 Claims, 3 Drawing Sheets

(51) Int. Cl.
*H01R 13/22* (2006.01)
*H01R 13/629* (2006.01)

(58) Field of Classification Search
CPC ..... H01R 11/12; H01R 13/02; H01R 31/02; H01R 4/4872; H01R 4/54
USPC ..... 439/712
See application file for complete search history.

(56) References Cited

U.S. PATENT DOCUMENTS

| | | | | |
|---|---|---|---|---|
| 5,273,464 | A * | 12/1993 | Rushing | H01R 31/02 362/234 |
| 6,794,576 | B1 * | 9/2004 | Justason | H01R 25/16 174/53 |
| 7,896,712 | B2 * | 3/2011 | Cecil | H01R 4/20 439/730 |
| 9,166,312 | B2 * | 10/2015 | Bakatsias | H01R 12/75 |

FOREIGN PATENT DOCUMENTS

| | | | |
|---|---|---|---|
| FR | 2 969 367 | A1 | 6/2012 |
| GB | 262 216 | A | 12/1926 |

OTHER PUBLICATIONS

Written Opinion for International Application No. PCT/FR2016/053314 dated Feb. 20, 2017.

* cited by examiner

VICE-TYPE TERMINAL BLOCK FOR INTERCONNECTING TWO THIMBLES AND ASSOCIATED CONNECTION

This is a National Stage application of PCT international application PCT/FR2016/063314, filed Dec. 9, 2016 which claims the priority of French Patent Application No. 15 62595 entitled "VICE-TYPE TERMINAL BLOCK FOR INTERCONNECTING TWO THIMBLES AND ASSOCIATED CONNECTION", FILED Dec. 17, 2015, both of which are incorporated herein by reference in their entirety.

TECHNICAL FIELD

The invention relates to the electrical terminations or connectors for power connections. More particularly, the invention relates to a vice-type terminal block for clamping a lug of a power cable to a second lug to electrically connect them together.

PRIOR ART

In the field of aircraft construction, it is increasingly common for aeroplanes to be built in pre-assembled segments, which are subsequently quickly connected on the assembly line for faster manufacture. These segments are already pre-fitted with wiring, pipework and structural connections, which simply require connection to those of the following segments.

Power supply cables are connected to other cables or electrical elements using electrical lugs provided at the end of each cable. Tubular lugs are often used, i.e. lugs having a tubular barrel for connection to the cable and a tongue substantially parallel to the barrel with a central hole. Such a conventional lug is connected to the other elements via a terminal block comprising a stud on which the tongue of the lug is positioned and a nut tightened on the stud. In order to connect two cables in a straight line, the lugs of two cables are positioned either on two different studs electrically connected to the same terminal block, or on the same stud, then secured together.

This can become problematic when the cable is twisted. Twisting is highly likely when routing a cable in a structure such as a segment of an aircraft. Typically, the lug must be oriented about the cable so that the hole of the tongue is aligned with the stud of the terminal block. For power supply cables of high stiffness (for example, as a result of a short length or a large cable cross-section), the change in orientation, which may need to be up to 180° to allow their connection, is particularly difficult.

Moreover, the connections described hereinabove entail the non-negligible risk of causing to foreign object damage (FOD). More particularly, a nut that comes loose, for example, can easily come away from the electrical connection and cause FOD.

As a result, a new type of lug has been developed to connect two cables which does not require any change in orientation. This lug is of the type comprising a barrel extending along an axis in a substantially centred manner for connection to an electrical cable and a flange connected to said barrel and extending radially relative to said barrel, said flange having, on the opposite side to where said barrel is located, an electrical contact surface substantially normal to said axis, intended to be placed in electrical contact with an electrical element.

A cable with such a lug can be electrically connected to a second cable having such a lug by placing the electrical contact surfaces facing one another. No axial orientation is required, given that the lugs have a frontal electrical contact surface, i.e. in the axial direction.

However, an adapted terminal block is required to clamp and maintain said two lugs in this position to ensure a good, reliable contact.

DESCRIPTION OF THE INVENTION

The purpose of this invention is therefore to propose a terminal block that is suitable for receiving two lugs of the type described hereinabove, such that their electrical contact surfaces face one another and are substantially aligned when the terminal block clamps the lugs with one another in order to connect two cables. Another purpose of the invention is to provide a terminal block that is easy to use, and that has a significantly reduced likelihood of being the cause of FOD or of being subjected to FOD.

This invention thus proposes a vice-type terminal block for electrically connecting a pair of lugs by clamping them together, each lug being of the type comprising a barrel extending along an axis in a substantially centred manner, and a flange connected to said barrel and extending radially relative to said barrel, said flange having, on the opposite side to where said barrel is located, an electrical contact surface substantially normal to said axis, the vice-type terminal block comprising two opposing plates and a clamping system for moving the two plates towards one another, characterised in that each plate comprises a slot for receiving one of said lugs such that the flange of the lug is substantially on one side of the plate and between the two opposing plates, whereas the barrel is substantially on the other side of the plate, the vice-type terminal block further comprising a means for supporting the pair of lugs such that their electrical contact surfaces face one another and are substantially aligned.

Preferably, said means for supporting the lugs comprises the bottom of at least one slot which is adapted to support the barrel of at least one lug.

Preferably, said means for supporting the lugs comprises a means adapted to support the flange of at least one lug.

Advantageously, each plate comprises three slots thereby allowing three pairs of lugs to be connected.

Preferably, each slot extends from an edge of the respective plate.

More preferably, the clamping system comprises at least one protruding portion that protrudes normally to the surface of the first plate, and at least one through hole located on the second plate, the protruding portion extending through the hole and comprising a cam mounted on the protruding portion.

Advantageously, the two plates comprise the counterbores adapted to receive the flanges of the lugs.

Preferably, the vice-type terminal block further comprises a protective cover.

This invention further proposes a connection comprising a vice-type terminal block such as that defined hereinabove, characterised in that the connection further comprises two lugs of the type comprising a barrel extending along an axis in a substantially centred manner, and a flange connected to said barrel and extending radially relative to said barrel, said flange having, on the opposite side to where said barrel is located, an electrical contact surface substantially normal to said axis, the lugs being positioned such that their electrical contact surfaces face one another, the vice-type terminal block clamping the flanges of said two lugs against one another in order to connect said lugs and maintain their position.

BRIEF DESCRIPTION OF THE FIGURES

This document will now describe, by way of non-limiting examples, one embodiment of the invention with reference to the appended figures, wherein.

In all of these figures, identical references may denote identical or similar elements. Moreover, the different parts shown in the figures are not necessarily displayed according to a uniform scale in order to make the figures easier to read.

DETAILED DESCRIPTION OF A SPECIFIC EMBODIMENT

Figure 1:
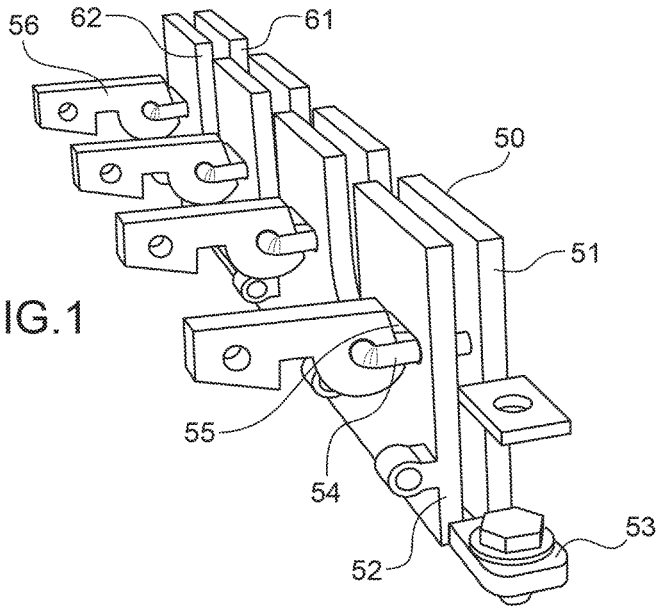
FIG. 1 shows a perspective view of a vice-type terminal block according to the first embodiment.

FIG. 1 shows a vice-type terminal block 50 according to a first embodiment of the invention for pressing two lugs 10 (FIG. 3) against one another. In this case, the vice-type terminal block 50 is adapted to receive and connect three pairs of lugs 10, however, it can be designed to connect more or fewer cables.

The vice-type terminal block 50 comprises two substantially rectangular, opposing plates 51, 52 that can move towards one another in order to clamp the lugs 10. A first plate 51 is intended to be fixed, and is referred to herein as a "fixed plate", whereas the second plate 52 is intended to be moved relative to the first plate 51, and is thus referred to herein as a "mobile plate". The two plates 51, 52 are of the same size, are substantially flat, have about the same thickness, and are preferably made of an insulating material (electrical non-conductor).

The fixed plate 51 has three slots 61 that descend vertically from the top edge in an inwards direction relative to the plate 51 for receiving lugs 10 of the cables 25. It further comprises four protruding portions 54 protruding from the surface of the fixed plate 51 facing the mobile plate 52. The protruding portions 54 extend substantially normally to the surface of the fixed plate 51, and are each U-shaped, more specifically in the shape of a round bar outlining a U with the two branches of the U being connected to the fixed plate 51 and the base of the U being located away from the fixed plate. These protruding portions 54 are intended to support cams 56 and at the same time guide the movement of the mobile plate 52.

Two mountings 53 with a central hole are attached to the fixed plate (one on the left and one on the right), which mountings 53 allow connection in a fixed manner to a structure, for example on a stiffener in a segment of an aeroplane.

The mobile plate 52 in turn has three slots 62 that descend vertically from the top edge in an inwards direction relative to the plate for receiving lugs 10 of the cables, which three slots 62 correspond respectively to those of the fixed plate 51. Moreover, the mobile plate 52 is also provided with four through holes 55 which correspond to the protruding portions 54 of the fixed plate 51. The two plates 51, 52 are arranged in a substantially parallel manner to one another and near one another, with the protruding portions 54 of the fixed plate 51 extending through the through holes 55 of the mobile plate 52.

Moreover, the vice-type terminal block 50 is provided with a clamping system for clamping the two plates 51, 52 of the vice-type terminal block 50 against one another. In particular, each of the terminations of the protruding portions 54, i.e. the bases of the U, are provided with a cam 56. The cams 56 are mounted so as to allow their rotation about the base of the U and thus allow the clamping or release of the two plates 51, 52. They comprise a handle that allows their manual rotation between the open position (horizontal) and the locked position (downwards). The cams 56 pass beyond their maximum point just before reaching the locked position. This helps the clamping system to remain in position once locked.

In order to reduce to likelihood of being the cause of FOD, the cams 56 are made in one piece. Preferably, they are mounted on the base of the U using additive manufacturing or 3D printing methods. The entire vice-type terminal block 50 can also be produced using these methods. Of course, other clamping means for the vice-type terminal block 50 can be envisaged instead of this cam-based clamping system.

When the vice-type terminal block 50 is clamped by its cams 56, the mobile plate 52 moves in translation, pushed by the cams 56 and guided by the protruding portions 54, towards the fixed plate 51, and the two plates 51, 52 press against one another to clamp, with a uniform force, the flanges 12 of the lugs 10 received in the vice-type terminal block 50 against one another.

Figure 2:
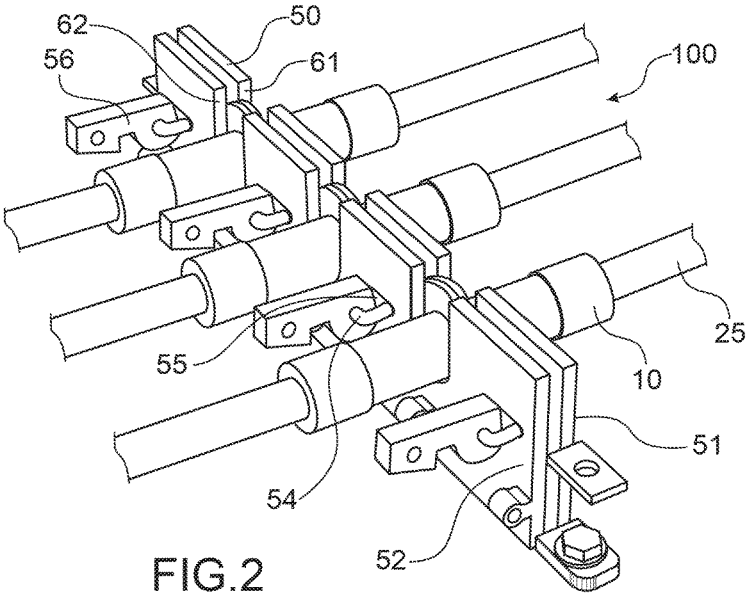
FIG. 2 shows a perspective view of a connection with the vice-type terminal block in FIG. 1, wherein three pairs of lugs are positioned facing one another, the vice-type terminal block being in the open position.

The invention shall be understood more clearly with reference to the connection shown in FIG. 2, comprising a vice-type terminal block 50 with three identical pairs of lugs 10. Each of the lugs 10 is crimped to its respective cable 25, and the three pairs are intended to be connected to form three complete cables (corresponding to three-phase electricity). The lugs 10 are made of metal, for example aluminium or copper, however can be provided with a coating surrounding the entire exterior of the lug with the exception of the electrical contact surface 13 which, in turn, is preferably treated (by nickel plating or stripping) to guarantee minimum contact resistance.

The two lugs 10 of each pair are positioned in the vice-type terminal block 50 with their electrical contact surfaces 13 facing one another in order to electrically connect their cables in a straight line, for example to connect a power cable of a segment of an aeroplane with a cable of a following segment.

The vice-type terminal block 50 comprises three pairs of opposing slots 61, 62, i.e. three slots per plate. Each slot 61, 62 descends vertically from the top edge of its plate 51, 52 to the same depth, about midway along the height of the plate 51, 52, and ends with a bottom. When the lugs 10 are inserted into their respective slots 61, 62, the barrel 11 of each lug 10 abuts against the bottom of the slot 61, 62, and the flange 12 of the lug 10 is substantially located on the side of the plate 51, 52 facing the opposing plate 52, 51 (i.e. between the two plates), whereas the barrel 11 is located substantially on the other side of the plate 51, 52.

Since the slots 61, 62 are directly opposite, and since the bases are at the same level, each pair of opposing lugs 10 has both their electrical contact surfaces 13 essentially aligned facing one another.

The vice-type terminal block 50 of the invention thus allows two lugs 10 of the type described to be easily connected, without requiring any change to the orientation of the lugs 10.

Figure 3:
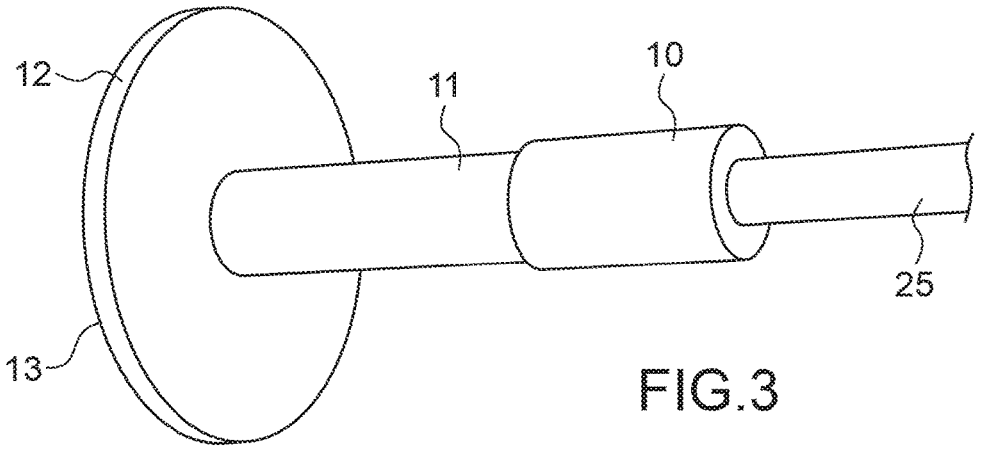
FIG. 3 shows a more detailed, perspective view of a lug of the type shown in FIG. 2.

FIG. 3 shows a more detailed view of the same lug 10 as those inserted in the vice-type terminal block 50 of the connection shown in FIG. 2, which lug 10 has a shape as described, however which further comprises other additional characteristics, giving it the shape generally preferred for use with the vice-type terminal block 50. In particular, the flange 12 extends radially relative to said barrel 11 such that it is substantially centred on said axis, i.e. such that the geometric centre of the flange 12 (viewed from the direction of the axis) is on the axis. Moreover, it is circular, as well as its electrical contact surface 13. Furthermore, the barrel 11 of the lug 10 is substantially cylindrical.

When two such lugs 10 are inserted into opposing slots 61, 62 of the vice-type terminal block 50, the barrel 11 of each lug 10 abuts against the bottom of the slot 61, 62 and will be supported such that the two electrical contact surfaces 13 will be aligned facing and fully overlapping one another. Since the flange 12 has a frontal surface, no specific axial orientation needs to be followed and the lugs 10 can be reliably connected without requiring any change in the orientation of the lug 10 about the axis of the barrel or of the cable 25. Moreover, since the flanges 12 are circular, the overlapping surface area between the flanges 12 of said two lugs 10 when they are facing one another will remain the same, as will the electric conductivity (the current density $A/mm^2$ capable of being carried for a given temperature rise), regardless of the relative axial orientation of the two lugs 10.

The shape of the barrel 11 of the lug 10 plays a role in ensuring that the flanges 12 align with one another. Since the barrel 11 is cylindrical, the central axis of the barrel will stay in the same position, regardless of the axial orientation of the barrel 11 when it is positioned at the bottom of the slot 61, 62. The flanges 12 of the lugs 10 facing one another can thus be easily aligned in a coaxial manner and with full overlap by placing the two barrels 11 at the bottom of the slots 61, 62, where they will be coaxial.

Of course, the vice-type terminal block 50 can receive and connect lugs where the shape of the flange is not circular, for example square. However, the overlap between the electrical contact surfaces of two such identical lugs presented facing one another, even if the flanges are centred and aligned on the same axis, will change depending on the relative angular orientation of the two lugs. The change in overlapping surface area involves a change in current carrying capacity and in the resistance of the connection. As a result, lugs 10 with flanges 12 that are circular in shape are generally preferred for use with said vice-type terminal block 50.

In order to support a pair of lugs 10 such that their electrical contact surfaces 13 are facing one another and substantially aligned, the vice-type terminal block 50 can be designed to support the flanges 12 of the lugs instead of the barrel 11. This may be particularly suitable when the flanges 12 are round.

In a variant, the vice-type terminal block can be designed to receive the lugs with a flange that is not flat, but may comprise, for example, a rounded surface on the side opposite the electrical contact surface to reinforce it.

It can be observed that there is only a small space between the two plates 51, 52 in the open position. This not only helps to maintain the lugs 10 inserted into the vice-type terminal block 50 in position, but also prevents a fitter from trying to connect two cables of insufficient length by forcing them together. Moreover, since the plates 51, 52 move in translation when the vice-type terminal block 50 is clamped, the forces to which the cables are subjected are mainly axial and the lugs 10 are therefore less likely to leave their slot 61, 62. As a result, the lugs 10 of the cables can be inserted in the right position facing one another, then the vice-type terminal block 50 can be clamped.

Once all of the lugs 10 of the cables to be connected are inserted, the vice-type terminal block 50 is clamped by its cam-based clamping system, the electrical contact surfaces 13 of the two lugs 10 press against one another to guarantee conductivity with low electrical resistance. The clamping also helps to withstand static loads and vibratory effects, by preventing any relative movement between the lugs 10, and between the lugs 10 and the vice-type terminal block 50.

Figure 4:
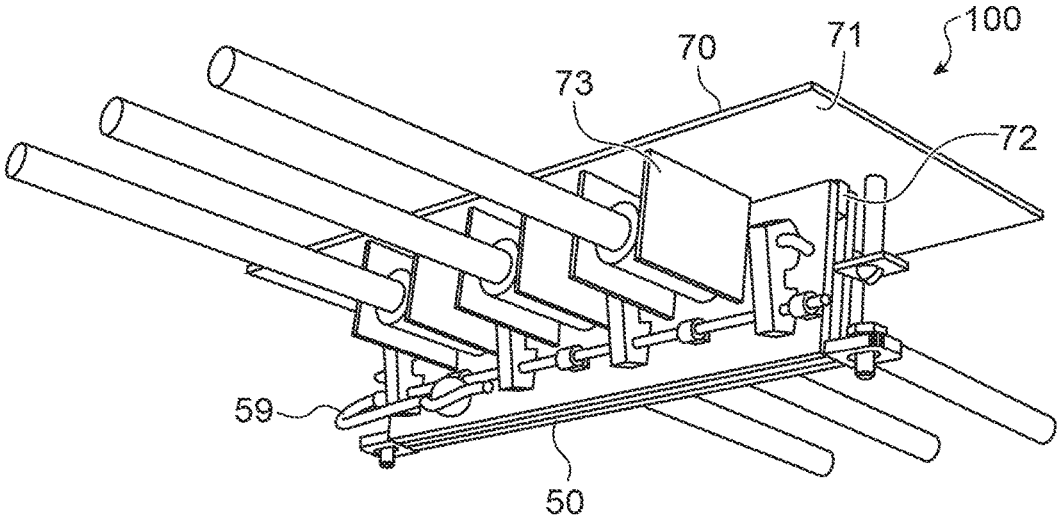
FIG. 4 shows a perspective view, from below and from the side, of the connection in FIG. 2, the vice-type terminal block being provided with a protective cover and being in the clamped position.

FIG. 4 shows the same connection 100 as that in FIG. 2, with the cams 56 in the locked position in which they clamp the two plates 51, 52 against one another and thus the flanges 12 of the lugs 10 against one another. In order to properly secure the cams 56 and prevent them from becoming unlocked (for example as a result of vibrations or impacts), a cotter pin 59 is used. The cotter pin 59 passes through the holes provided on the handles of the cams and the attachment points on the vice-type terminal block 50 in an interleaved manner, and is then in turn secured such that it does not come undone.

A protective cover 70 is used to reduce the risk of being affected by FOD. It comprises a horizontal rectangular plate 71, a central plate 72 extending in the direction of the length of the rectangular plate 71 and downwards, intended to be clamped by the vice-type terminal block 50, and several side plates 73 extending in the direction of the width of the horizontal, rectangular plate 71 and downwards. The protective cover 70 is used, to a certain extent, to physically isolate the three lugs 10 by forming a small partition wall around each lug 10 to prevent an object or a liquid from falling onto the connection 100 and thus causing a short-circuit. It is clipped to the vice-type terminal block 50. Apart from protecting the connection 100, it also serves to prevent the lugs 10 from exiting the slots 61, 62. The protective cover 70 is preferably also made of an insulating material, and can be connected to the vice-type terminal block 50 as required.

Figure 5:
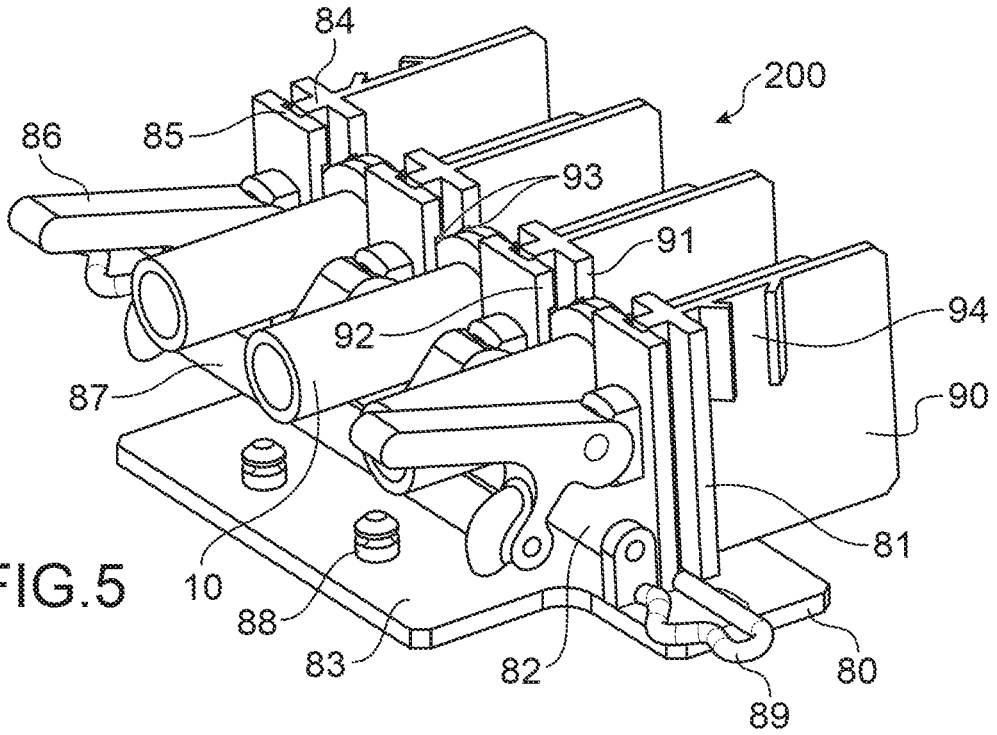
FIG. 5 shows a perspective view of a connection with a vice-type terminal block according to a variant, the vice-type terminal block being in the open position.

FIG. 5 shows a connection 200 comprising a variant of a vice-type terminal block 80 similar as a whole to that described hereinabove, however comprising several changes. The fixed plate 81 is more substantial, having a mounting 83 in the form of a base plate, and side plates 90.

The clamping system comprises four cams 86, but in this case, only two cams 86 are provided with handles allowing for their manual rotation. However, the cams 86 are all connected in rotation by a bar 87, and thus actuation of the two cams 86 provided with handles actuates all four cams 86.

In order to prevent any relative movement between the plates 81, 82 of the terminal block 80 in the clamped state, the plates 81, 82 comprise cooperating ribs 84 and grooves 85 on their sides which face the opposing plate. Moreover, said opposing sides of the plates 81, 82 are provided with counterbores 93 adapted to receive the flanges 12 of the lugs 10, the counterbores 93 being circular and provided around the bottom of each slot 91, 92. This prevents the lugs 10 from sliding along their slot 91, 92. The edges of said counterbores 93 also help support the flanges 12 such that they are aligned. Finally, two pins 89 are used (one on the left and one on the right) to properly secure the cams 86.

Figure 6:
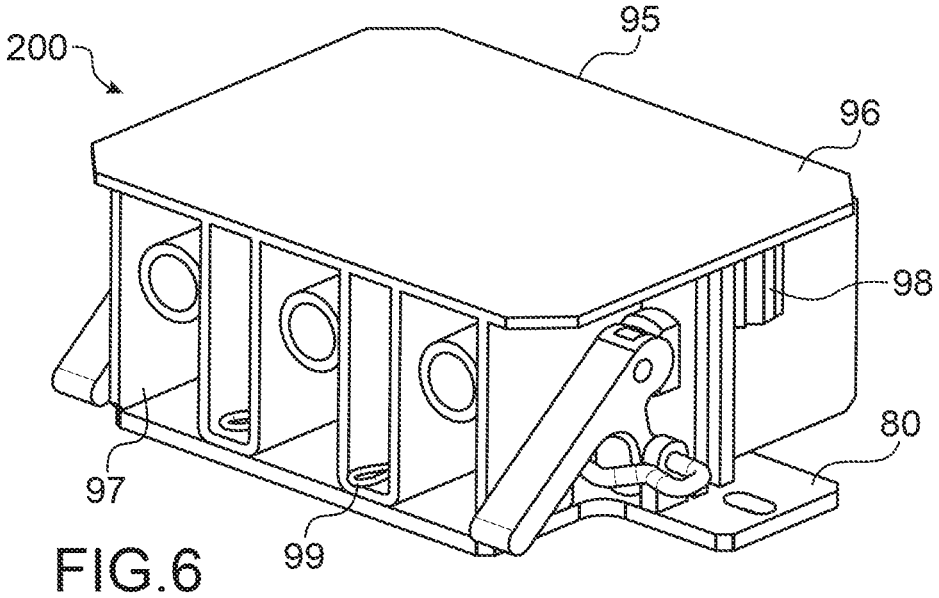
FIG. 6 shows the connection in FIG. 5, the vice-type terminal block being provided with a protective cover and being in the clamped position.

FIG. 6 shows the connection 200 in FIG. 5 with a protective cover 95 positioned on the top of the vice-type terminal block 80. The protective cover 85 comprises a horizontal plate 96 and side plates 97. It further comprises formations for engaging with complementary formations on the fixed plate 81 of the vice-type terminal block 80. In this case, two vertical rods 98 on the protective cover are slid into the corresponding grooves 94 on the fixed plate 81. Once in place, the protective cover 95 is secured to the vice-type terminal block 80 by fixing the pins 99 onto studs 88 provided on the fixed plate 81.

It will be clear to one skilled in the art that other clamping systems may be suitable instead of the cam-based clamping systems described above for bringing together and clamping the two plates of the vice-type terminal block. For example, a single cam-based system exerting a load over the entire length of the vice-type terminal block can be envisaged. Alternatively, the two plates of the terminal block can be connected by quarter-turn quick connectors, or by another clamping system.

It goes without saying that the vice-type terminal block can receive and connect the lugs of the type described but with the flange connected to the barrel in a non-centred manner, in other words, with its geometric centre not being on the axis. However, lugs having flanges connected in a centred manner are preferred for practical purposes and for a more reliable connection.

Although a terminal block with two plates that move in translation is preferred, the two plates can be designed to pivot relative to one another, for example connected along their lower edge. The terminal block can also be designed to connect more or fewer cables depending on the installation, for example with only two pairs of opposing slots for the two direct voltage cables.

The invention is not limited to the field of aircraft, and is also suitable for use in other fields involving construction in segments or modular construction methods such as those of ships, buildings, or more generally any field in which a cable must be connected to an electrical element.

The embodiment described hereinabove is provided for illustration purposes only and must not be interpreted restrictively. It should be noted that other embodiments or improvements to the invention will be clear to one skilled in the art without departing from the general scope of the claims.

What is claimed is:

1. A vice-type terminal block for electrically connecting a pair of lugs by clamping them together, each lug comprising a barrel extending along an axis in a centered manner, and a flange connected to said barrel and extending radially relative to said barrel, said flange having, on an opposite side to where said barrel is located, an electrical contact surface normal to said axis, the vice-type terminal block comprising:

two opposing plates and a clamping system for moving the two plates towards one another, wherein each plate comprises a slot for receiving one of said lugs thereby positioning the flange of each respective lug on one side of the respective plate and also between the two opposing plates, also thereby positioning the barrel of each respective lug on the other side of the plate opposite the one side, and a means for supporting the pair of lugs such that their electrical contact surfaces face one another and are aligned.

2. A vice-type terminal block according to claim 1, wherein said means for supporting the lugs comprises a bottom of at least one slot which is adapted to support the barrel of at least one lug.

3. A vice-type terminal block according to claim 1, wherein said means for supporting the lugs comprises a means adapted to support the flange of at least one lug.

4. A vice-type terminal block according to claim 1, wherein each plate comprises three slots thereby allowing three pairs of lugs to be connected.

5. A vice-type terminal block according to claim 1, wherein each slot extends from an edge of the respective plate.

6. A vice-type terminal block according to claim 1, wherein the clamping system comprises at least one protruding portion that protrudes normally to the surface of the first plate, and at least one through hole located on the second plate, the protruding portion extending through the hole and comprising a cam mounted on the protruding portion.

7. A vice-type terminal block according to claim 1, wherein the plates comprise counterbores adapted to receive the flanges of the lugs.

8. A vice-type terminal block according to claim 1, wherein the vice-type terminal block further comprises a protective cover.

9. A connection comprising the vice-type terminal block according to claim 1, further including the pair of lugs being positioned such that their electrical contact surfaces face one another, and the vice-type terminal block clamping the flanges of said pair of lugs against one another to connect said lugs and to maintain their position.

* * * * *